United States Patent [19]

Mayfield, Jr. et al.

[11] 4,424,775

[45] Jan. 10, 1984

[54] APPARATUS FOR MAINTAINING A DIESEL ENGINE IN RESTARTING CONDITION

[75] Inventors: John M. Mayfield, Jr., Ukiah; Vernon W. Haselswerdt, Willits; Hugh A. Hinchliffe, Ukiah, all of Calif.

[73] Assignee: Microphor, Inc., Willits, Calif.

[21] Appl. No.: 319,113

[22] Filed: Nov. 9, 1981

[51] Int. Cl.[3] ..... F02N 17/02

[52] U.S. Cl. ..... 123/142.5 R

[58] Field of Search ..... 123/142.5 R

[56] References Cited

U.S. PATENT DOCUMENTS

| | | | |
|---|---|---|---|
| 1,974,907 | 9/1934 | Worth | 123/142.5 R |
| 1,992,568 | 2/1935 | Connor | 123/142.5 R |
| 2,070,615 | 2/1937 | Plante | 123/142.5 R |
| 2,155,776 | 4/1935 | Starr | 123/142.5 R |
| 2,630,106 | 3/1953 | Butts | 123/142.5 R |
| 2,664,870 | 1/1954 | Wiseman | 123/142.5 R |
| 3,373,728 | 3/1968 | Collins | 123/142.5 R |

*Primary Examiner*—Ira S. Lazarus

*Attorney, Agent, or Firm*—Christie, Parker & Hale

[57] ABSTRACT

A large primary engine is maintained in readiness to start under low ambient temperature conditions by a small auxiliary engine having a liquid cooling system in parallel with the cooling system of the primary engine. Exhaust from the auxiliary engine heats the coolant circulating through the two engines in a heat exchanger. The lubricating oil from the primary engine is also heated by the auxiliary engine exhaust in the same heat exchanger. A generator driven by the auxiliary engine charges the batteries used to start the primary engine.

4 Claims, 3 Drawing Figures

APPARATUS FOR MAINTAINING A DIESEL ENGINE IN RESTARTING CONDITION

FIELD OF THE INVENTION

This invention relates to apparatus for maintaining a large diesel engine in restarting condition under low ambient temperature conditions.

BACKGROUND OF THE INVENTION

Large diesel engines such as used in railroad locomotives, heavy earth-moving equipment and the like, can be difficult to start, particularly at low operating temperatures. Starting the diesel engines requires a large amount of electrical energy. The only source of electrical energy may be a bank of batteries whose ability to produce large amounts of energy is also adversely affected by low ambient temperature operating conditions. If the energy from the batteries is insufficient for starting, auxiliary power must be available. For these and other reasons, it is the practice to leave the engine running when not in use, particularly where the locomotive is in a yard or siding and auxiliary power is not readily available. However, a locomotive may burn in the order of 6 to 8 gallons per hour, resulting in a substantial wasted fuel cost when measured in terms of the number of hours of locomotive non-use.

Various systems have heretofore been proposed to maintain an engine heated even though it has been shut down. For example, U.S. Pat. Nos. 4,245,593 and 4,249,491 show an arrangement for using an electric heater for preheating both the lubricating oil and the coolant of an engine to make it easier to start. Such an arrangement, however, requires access to a source of electrical power, which may not always be available. Using the heat from another engine has also been proposed by providing a temporary connection between the two liquid cooling systems for transferring heat from one engine to another. See, for example, U.S. Pat. Nos. 3,373,728 and 4,051,825. Problems arise with such arrangements, including the possibility that the engine will be started and driven off with the heated water systems still attached. Trade union restrictions may also require special personnel to make the necessary interconnection. It also requires that another engine equipped with suitable connecting attachments be available.

SUMMARY OF THE INVENTION

The present invention is directed to an improved arrangement for maintaining a diesel locomotive or the like in condition for reliable restarting when not in use. The arrangement of the present invention requires no source of energy external to the locomotive, either in the form of electrical power or a heated fluid to be connected to the locomotive engine. The present system provides a highly efficient use of the diesel fuel for keeping both the engine coolant and the engine lubricating oil sufficiently warm while maintaining the batteries at peak charge for a sustained period of time to enable easy restarting of the engine.

These and other advantages of the present invention are achieved by providing an arrangement in which a small auxiliary engine is provided which runs off the diesel fuel supply of the main engine. Exhaust from the auxiliary engine is passed through a heat exchanger which transfers heat to a liquid coolant that is circulated through both the main engine and auxiliary engine by a small pump. The lubricating oil of the main engine is also circulated through the heat exchanger to warm the oil from the exhaust of the auxiliary engine. The auxiliary engine, in addition, drives a generator which provides electrical power to maintain a full charge in the battery bank of the locomotive and also to provide power for heating the diesel fuel to prevent wax precipitation.

BRIEF DESCRIPTION OF THE DRAWINGS

For a better understanding of the invention, reference should be made to the accompanying drawings, wherein.

DETAILED DESCRIPTION

Figure 1:
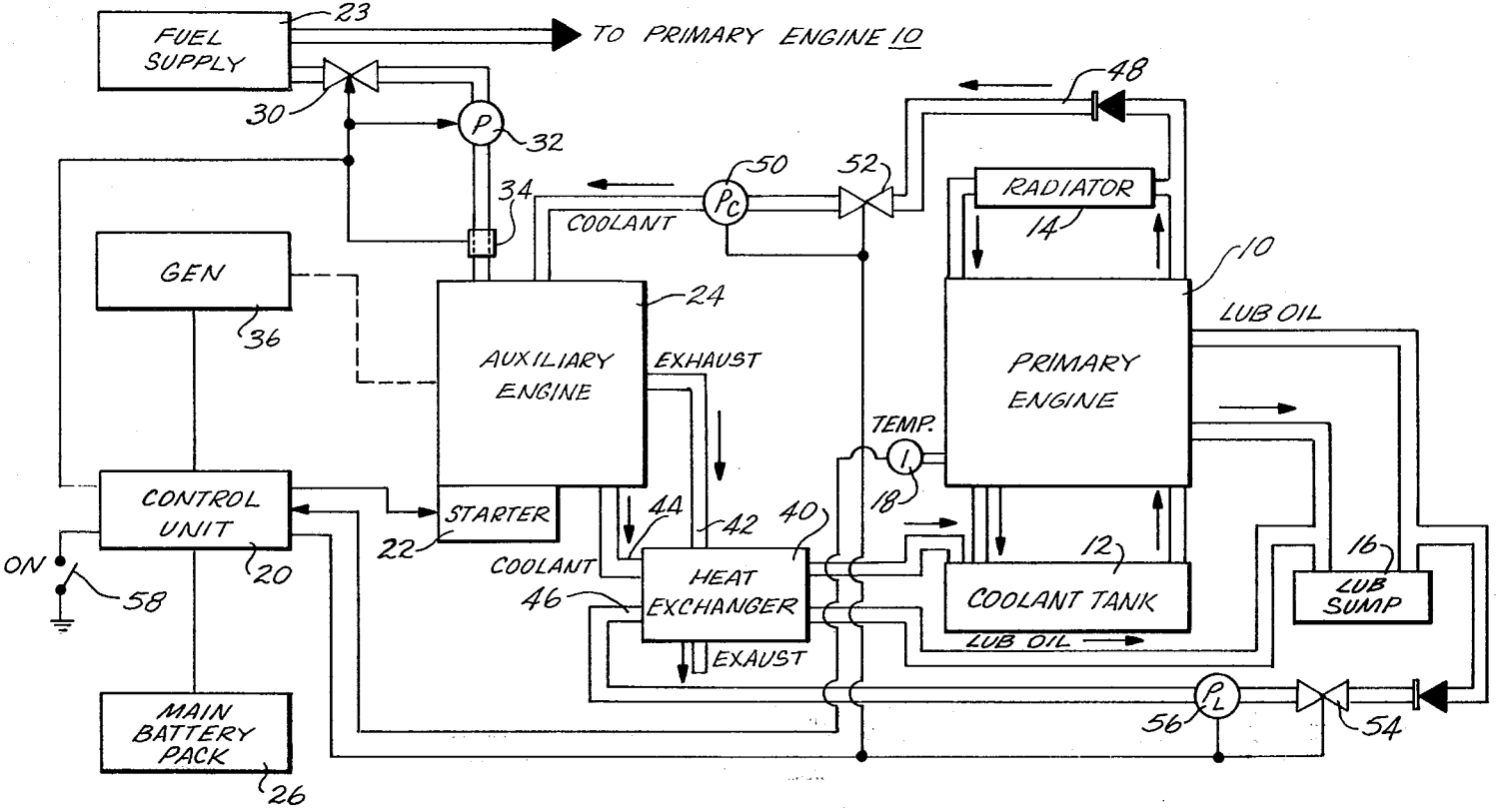
FIG. 1 is a schematic diagram of a preferred embodiment of the present invention.

Referring to FIG. 1 in detail, the numeral 10 indicates generally an internal combustion engine such as the diesel engine of a railway locomotive. However, it is to be understood that the invention is not limited to a diesel engine but may be applicable to any large internal combustion engine which needs to be started and operated under frigid conditions. Such engines normally include a liquid cooling system and a pressurized oil lubication system. When the engine is running, the liquid cooling system circulates the coolant through the engine block of the main engine and then passes the coolant through a radiator or other suitable heat exchanger 14 before returning the coolant to the engine. An expansion tank 12 is provided to maintain adequate coolant and allow for expansion of the coolant with increased temperature. The cooling system is designed to maintain the engine temperature substantially constant over a wide range of ambient temperature conditions. The coolant may also be used to keep the lubricating oil cool, or the lubricating system may have its own radiator.

When the engine 10 is shut down, its temperature, along with the temperature of the coolant, and the lubricating oil, gradually cools down to the temperature of the surrounding air, which, under some conditions may be substantially below 0° F. At these temperatures, the lubricating oil does not function effectively and the resulting buildup of friction can impose very high torque loads on the starter motor. Also at these temperatures, the chemical action of the batteries slows down and they are not able to deliver the power necessary to turn the engine over. For this reason, even when a locomotive or other equipment is not in use, the engine is generally allowed to idle since restarting may be very problematical.

The present invention provides a fuel saving solution to this problem. When the primary engine 10 is shut down, a thermostat 18 senses the drop in engine temperature. When the temperature drops below a predetermined level, such as 120° F., the thermostat signals a control unit 20 which then energizes a starter 22 on an auxiliary engine 24 from the main battery pack 26 of the locomotive or other equipment driven by the primary engine 10. The auxiliary engine 24 preferably operates off the same fuel supply 28 as the primary engine 10. The control unit 20, in addition to activating the starter 22, turns on a valve 30 and pump 32 for pumping fuel from the fuel supply 28 to the auxiliary engine 24. The control unit 20 also activates an electric heater 34 which heats the fuel going to the auxiliary engine 24.

The auxiliary engine 24 drives an alternator or generator 36 which is connected by the control unit 20 to the main battery pack 26 to maintain a full charge in the batteries. At the same time the generator provides auxiliary electrical power to the electrical system of the locomotive.

Once the auxiliary engine 24 is started, it is also used to keep the coolant and lubricating oil of the primary engine 10 at or above a minimum temperature level which permits the primary engine 10 to be restarted without overloading the fully charged main battery pack 26.

Figure 2:
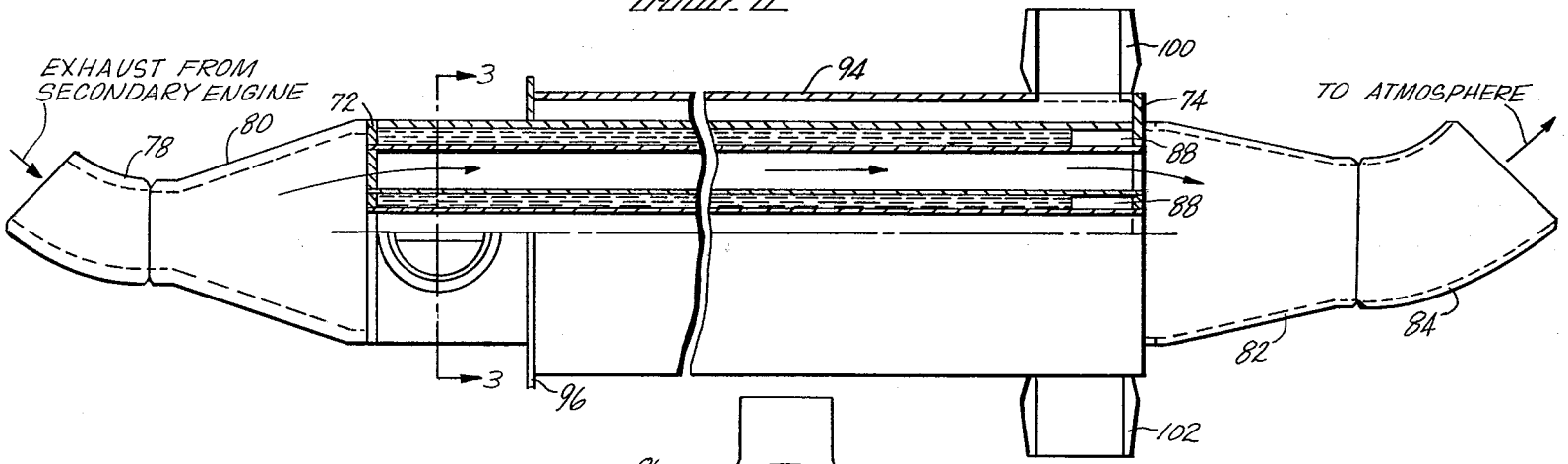
FIG. 2 is a sectional view of the heat exchanger.
Figure 3:
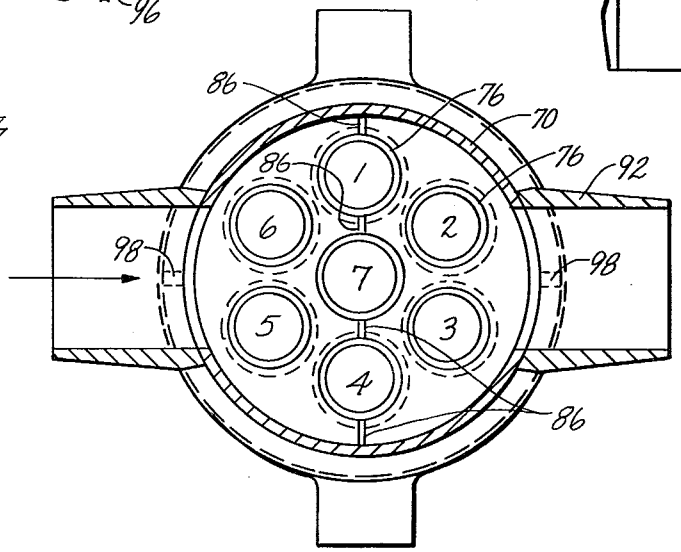
FIG. 3 is a cross-sectional view of the heat exchanger.

To this end, the exhaust from the auxiliary engine 24 is directed through a heat exchanger 40. The heat exchanger 40, which is described in detail below in connection with FIGS. 2 and 3, is constructed with three fluid passages which are in heat exchanging relationship. The exhaust gases pass through a first passage 42. Engine coolant from the auxiliary engine 24 passes through a second passage 44 while lubricating oil from the primary engine 10 extends through a third passage 46.

The engine coolant passage 44 is part of a closed loop system in which coolant from the tank 12 is pumped through the primary engine 10 and radiator bypass 48 by a pump 50. The pump 50 discharges into the cooling system of the auxiliary engine 24 where it picks up heat from the auxiliary engine before passing through the passage 44 of the heat exchanger 40 back to the coolant tank 12 of the primary engine. The pump 50 and a valve 52 are activated by the control unit 20 after the auxiliary engine 24 is started.

Similarly the lubricating oil in the sump 16 is pumped through the passage 46 of the heat exchanger 40 through a valve 54 by a pump 56. The valve and pump are activated at the same time as the pump 50 and the valve 52. The lubricating oil, as it passes through the heat exchanger 40, draws heat from the auxiliary engine exhaust and circulates the warm oil in the primary engine 10.

The auxiliary engine heating system can be disarmed by an ON/OFF switch 58 associated with the control unit 20.

With the auxiliary engine 24 running, the circulating coolant picks up heat directly from the auxiliary engine 24 and also from the exhaust of the auxiliary engine by means of the heat exchanger 40. Thus the system takes full advantage of the thermal energy loss of the auxiliary engine, transferring the energy to the main engine. At the same time the mechanical energy of the auxiliary engine is used to drive the generator and store the energy in electrical form in the main battery pack 26. Excess thermal energy from the auxiliary engine 24 is also transferred to the lubricating oil, thus keeping the oil fluid and ready to flow through the engine to further reduce the starting load on the batteries. When the auxiliary engine is not running, the cooling system is isolated from the primary engine 10 and in no way interferes with the normal operation of the primary engine. It is also possible to use the radiator 14 in the cooling system of the auxiliary engine 24, if necessary, to maintain the temperature of the auxiliary engine 24 below the required operating limits.

Because the present invention provides a highly efficient transfer of energy from the auxiliary engine to the primary engine, the auxiliary engine may be quite small in relation to the primary engine. For example, it has been found that a single cylinder diesel engine-generator set consuming fuel at the rate of four pounds per hour is capable of generating 3.5 KW of electrical power and at the same time transferring approximately 50 KBTU/HR to the primary engine. This is sufficient heat to keep a 1500 horsepower diesel engine from dropping below 50° F. at an ambient temperature of −20° F. Moreover, at −20° the primary engine takes approximately 10 hours to reach this temperature after it is shut down. Thus the present invention provides a highly efficient and effective way of maintaining the primary engine in restarting condition under adverse operating conditions.

The triaxial flow heat exchanger 40 is shown in more detail in FIGS. 2 and 3. The heat exchanger includes a cylindrical outer wall or housing 70 which terminates at each end in headers 72 and 74. The headers support a plurality of tubes 76 which pass through holes in the headers and are welded or otherwise secured and sealed to the headers. Exhaust gases from the auxiliary engine are directed through the tubes 76 through an input pipe 78 and a conical expander section 80 which is welded or otherwise secured to the header 72. A reducer section 82 and outlet pipe 84 direct the exhaust gases to the atmosphere after they have passed through the heat exchanger tubes 76.

The space between the heat exchanger tubes 76 and the outer housing 70 is divided into two regions by a series of metal divider strips 86, which lie in a common vertical plane extending along the axis of the housing 70. The divider strips are welded or otherwise secured in the spaces between the tubes and the housing, as best shown in FIG. 3. The divider strips extend lengthwise of the housing from the header 72 for a distance slightly less than the length of the tubes, thereby leaving openings, such as indicated at 88, between the header 74 and the ends of the divider strips. Coolant from the auxiliary engine 24 is directed into the housing of the heat exchanger through an input pipe connection 90 adjacent the header 72. The coolant flows lengthwise of the tubes on one side of the divider strips 86 toward the header 74 where it passes through the openings 88. The coolant then flows back through the housing toward the header 72 and is discharged through an outlet pipe 92 adjacent the header 72. Thus the engine coolant from the auxiliary engine picks up additional heat from the engine exhaust as it passes through the heat exhanager tubes 76.

In addition, a cylindrical jacket 94 surrounds the cylindrical housing 70. The jacket 94 terminates against the header 74 at one end and is welded or otherwise secured in sealed relation to the header 74. The other end of the cylindrical jacket 94 terminates in a flange 96 extending around the outside of the housing 70. The jacket 94, the outside of the housing 70, the header 74 and the flange 96 thus form an annular space surrounding the outside of the heat exchanger. This annular space is divided into an upper and lower region by a pair of divider strips 98 which extend from the header 74 at one end and terminate short of the flange 96 to leave openings between the upper and lower regions of the annular space. Lubricating oil from the primary engine is pumped through the annular space within the jacket 94 through an input pipe connection 100, and the heated oil is returned to the primary engine through an output pipe connection 102. The lubricating oil picks up heat from the heated coolant circulating in the space within the cylindrical housing 70. The coolant protects the lubricating oil from overheating due to direct contact with the heat exchanger tube 76 through which the hot exhaust gases are directed.

What is claimed is:

1. A standby system for maintaining a liquid cooled primary engine in restarting condition at very low ambient temperatures after the primary engine is shut off, the primary engine being of a type having a liquid cooling system including a radiator connected to the primary engine for normally cooling a coolant liquid circulated through the engine block and the radiator, and an expansion tank into which the coolant drains, the standby system comprising:

an auxiliary engine having a liquid cooling system, a heat exchanger having at least two fluid passages therethrough for transferring heat from one fluid to another, fluid passage means including a pump, the auxiliary engine cooling system, and one passage of the heat exchanger, one end of said fluid passage means being connected to the expansion tank and the other end being connected to the outlet connection from the primary engine block to the radiator, said pump directing fluid through the primary engine block, the auxiliary engine block, and the heat exchanger in a closed path that shunts the radiator, for transferring heat from the auxiliary engine to the primary engine block, and means directing exhaust gases from the auxiliary engine through another passage of the heat exchanger.

2. Apparatus of claim 1 further including thermostat means for sensing the temperature of the primary engine, and means responsive to the the thermostat means for starting the auxiliary engine and said pump when the temperature of the primary engine drops below a predetermined level.

3. Apparatus of claim 1 further including electrical generator means driven by the auxiliary engine independently of the primary engine, battery means for starting the primary engine, and means charging the battery means from the electrical generator means.

4. Apparatus of claim 3 wherein the primary engine includes a lubricating oil circulating system, and means including a pump and valve means for circulating lubricating oil through the circulating system of the primary engine, the pump being driven by the generator means.

* * * * *